US007497052B2

(12) United States Patent
Hu

(10) Patent No.: US 7,497,052 B2
(45) Date of Patent: Mar. 3, 2009

(54) SCISSORS TYPE VERTICAL ELEVATED SUBSTRUCTURE

(75) Inventor: Dexiang Hu, Liaoning (CN)

(73) Assignee: Equipment Engineering Company of Liaohe Petroleum Exploration Bureau, CNPC, Liaoning (CN)

( * ) Notice: Subject to any disclaimer, the term of this patent is extended or adjusted under 35 U.S.C. 154(b) by 440 days.

(21) Appl. No.: 11/404,907

(22) Filed: Apr. 17, 2006

(65) Prior Publication Data

US 2007/0240909 A1 Oct. 18, 2007

(51) Int. Cl.
*E04H 12/18* (2006.01)

(52) U.S. Cl. ..... 52/111; 52/646; 248/277.1

(58) Field of Classification Search ..... 52/111, 52/117, 646, 109, 120, 108; 182/69.5; 248/277.1, 248/188, 125.2, 157; 173/184; 187/269, 187/211; 254/122
See application file for complete search history.

(56) References Cited

U.S. PATENT DOCUMENTS 649,306 A * 5/1900 Hicks ..... 182/69.5
1,531,982 A * 3/1925 Sago ..... 182/41
3,009,546 A * 11/1961 Anderson, Sr. et al. ..... 52/108
4,391,345 A * 7/1983 Paul ..... 182/141
4,718,519 A * 1/1988 Barker ..... 254/122
5,184,444 A * 2/1993 Warden ..... 52/646
5,593,137 A * 1/1997 Johnson ..... 254/122
6,371,247 B1 * 4/2002 Nedderman, Jr. ..... 187/211
7,231,741 B2 * 6/2007 Norwood ..... 52/118
2002/0139618 A1 * 10/2002 Anibas ..... 187/211
2008/0169158 A1 * 7/2008 Lam ..... 187/211

* cited by examiner

*Primary Examiner*—Richard E Chilcot, Jr.
*Assistant Examiner*—Anthony N Bartosik
(74) *Attorney, Agent, or Firm*—Birch, Stewart, Kolasch & Birch, LLP

(57) ABSTRACT

A scissors type vertical elevated substructure. The base and the surface of the substructure are articulated through folding legs. The nodes of the legs are articulated through connection rods and form double parallelograms which are mirror images and share a common base. There is a guide device on the base. Lifting sheaves are installed on both the surface of the substructure and the top of the guide. One end of the lifting wireline is fixed on the nodes of the folding legs and the other end of the wireline runs around the lifting sheaves in a given order to connect with the drawworks. The guide pulley sits in the vertical elevated guide-rail which is set on the guide device. The support rod is fixed to the base, the surface, and the folding legs.

5 Claims, 3 Drawing Sheets

SCISSORS TYPE VERTICAL ELEVATED SUBSTRUCTURE

BACKGROUND OF THE INVENTION

The present invention relates to a scissors type vertical elevated substructure for an oil drilling rig. Existing technology requires large and heavy substructures for drilling rigs. The vertical elevated substructure for these occupies a large amount of area and is costly to transport and require much time to install.

SUMMARY OF THE INVENTION

This new type of scissors vertical elevated substructure will solve many technical problems. Design a vertical elevated substructure that is small, light, strong, and self-elevated vertically with less lifting load under the constraints of the vertical elevated guide-rail. This design enhances the performance and economics of each individual drilling operation as it saves time when transporting and installation. The unit can be moved to another well site at once if conducting shallow well drilling and the transportation times can be reduced 50% when compared to that of similar conventional units if conducting deep well drilling.

According to principles of this invention a scissors type vertical elevated substructure includes a base (1), and a surface (2).

The base (1) and surface (2) of the substructure are articulated by folding legs (3).

The nodes of the legs (3) are articulated through connecting rods (4) and form double parallelograms which are mirror images and share a common base.

There is a guide device (5) on the base (1).

Lifting sheaves (6), (7) are installed on the surface of the substructure and (8) on the top of the guide device (5).

One end of the lifting wireline (9) is fixed on the nodes of the folding legs (3) and, the other end of the wireline runs around the lifting sheaves (6), (8), (7) in a given order to connect with the drawworks.

There is a guide pulley (12) on the surface (2) of the substructure and a vertical elevated guide-rail (13) on the guide device (5).

The guide pulley (12) is sitting in the vertical elevated guide-rail (13).

The support rods (10), (11) are fixed to the base (1), the surface (2) and the folding legs (3).

The folding legs (3) are a variable number whose ends are all articulated with the base (1) and the surface (2) and whose nodes are articulated with the connection rods (4). The number of the folding legs depends upon the amount of equipment on the drill floor and the size of the drill floor.

The lifting sheaves (7) and (8) belong to the pulley assembly.

The guide device (5) is set on one side of the base (1) and its upper part can be folded downward.

Compared with present techniques this design enhances the performance and economics of each individual drilling operation as it saves time when transporting and installation. The unit can be moved to another well site at once if conducting shallow well drilling and the transportation times can be reduced 50% when compared to that of similar conventional units if conducting deep well drilling.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTIONS OF DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
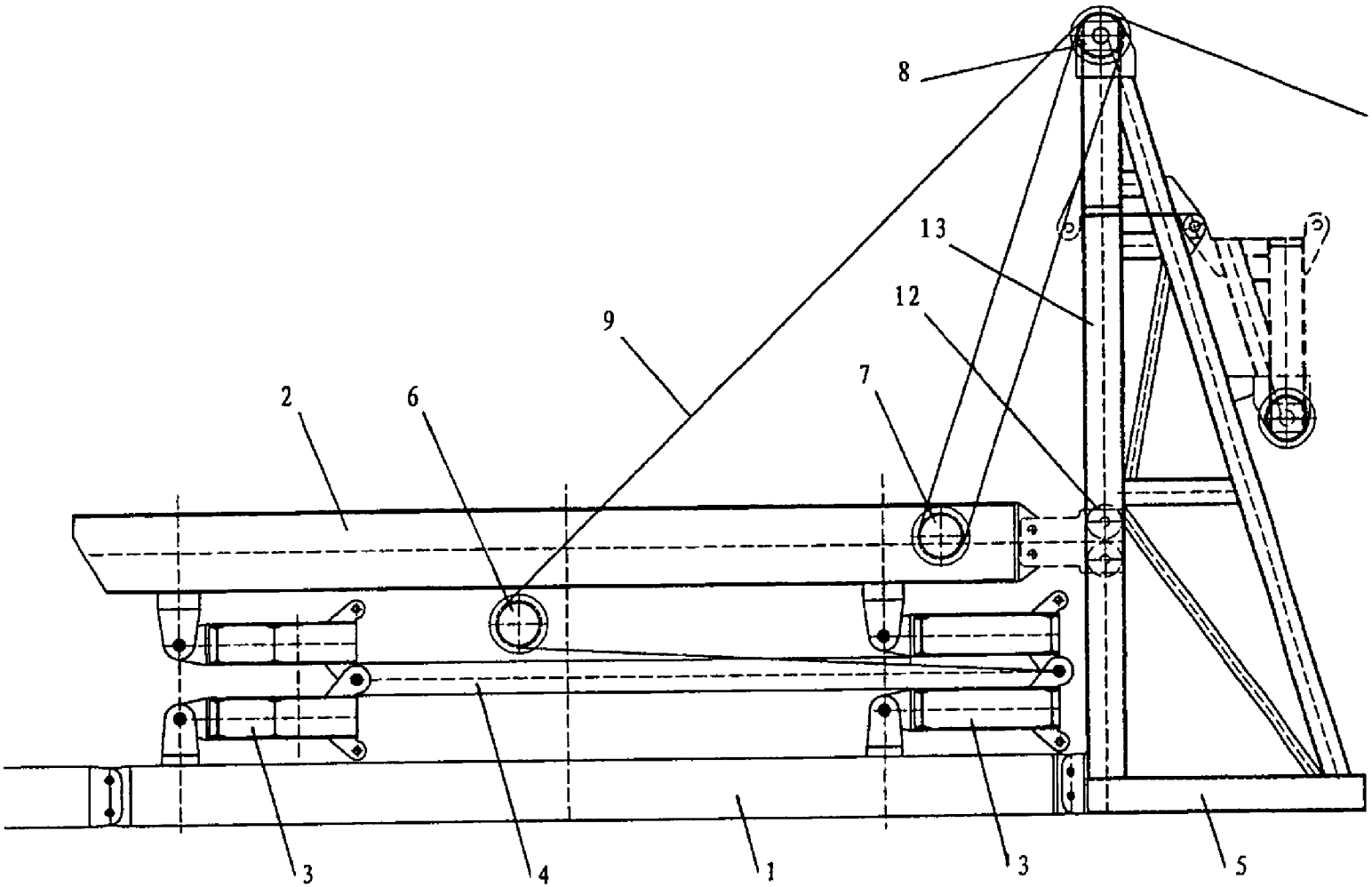
FIG. 1 is the schematic plan of the structure of the new practical type substructure.
Figure 2:
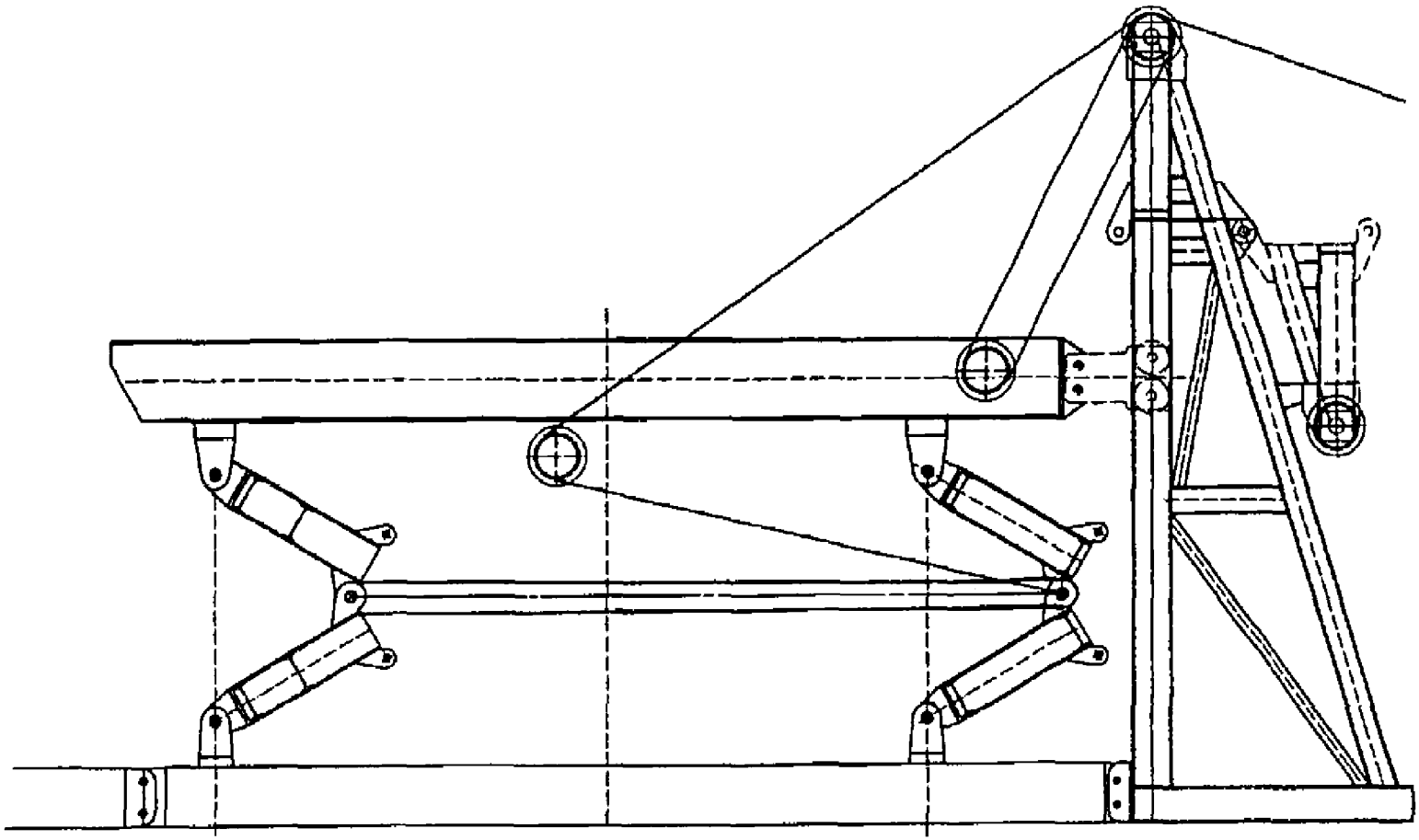
FIG. 2 is the schematic plan of the lifting process of the new practical type substructure.
Figure 3:
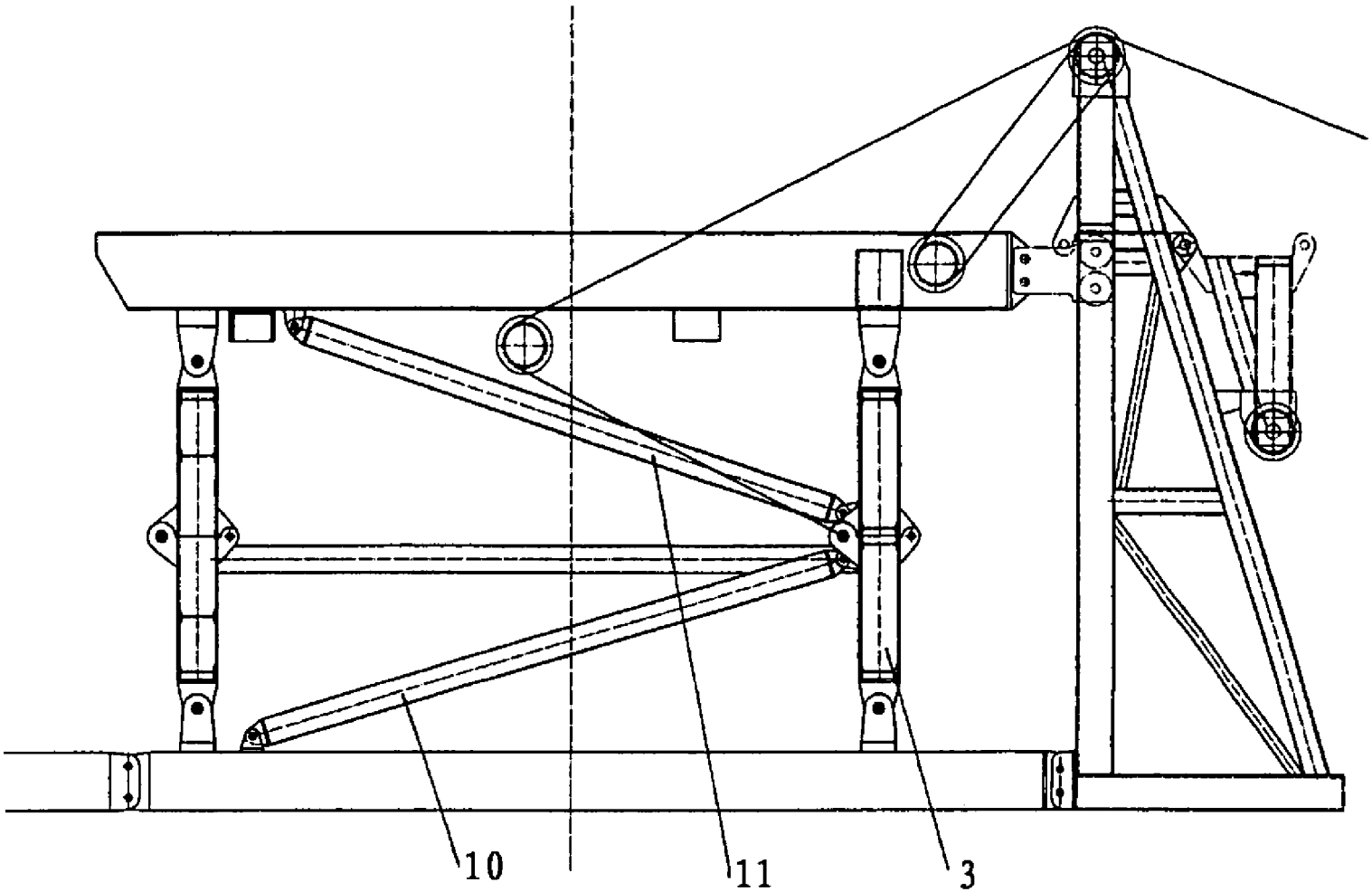
FIG. 3 is the schematic plan of the lifted position of the new practical type substructure.

The applications are described according to FIGS. 1, 2 and 3.

A scissors type vertical elevated substructure which includes: Base (1), and surface (2).

The base (1) and surface (2) of the substructure are articulated by folding legs (3).

The nodes of the legs (3) are articulated through connecting rods (4) and form double parallelograms which are mirror images and share a common base.

There is a guide device (5) on the base (1).

Lifting sheaves (6), (7) are installed on the surface of the substructure and (8) on the top of the guide device (5).

One end of the lifting wireline (9) is fixed on the nodes of the folding legs (3) and, the other end of the wireline runs around the lifting sheaves (6), (8), (7) in a given order to connect with the drawworks.

There is a guide pulley (12) on the surface (2) of the substructure and a vertical elevated guide-rail (13) on the guide device (5).

The guide pulley (12) is sitting in the vertical elevated guide-rail (13).

The support rods (10), (11) are fixed to the base (1), the surface (2) and the folding legs (3).

The guide device (5) is set on one side of the base (1) and its upper part can be folded downward.

Next the lifting process will be described. The drawworks pulls the lifting wireline (9) and, the lifting wireline (9) raises the substructure surface (2) vertically through pulley assembly (7) and (8) under the restraint of the vertical elevated guide-rail (13). The lifting wireline (9) pulls the folding legs (3) simultaneously. When the surface of the substructure is in its final position, the folding legs (3) then are pulled straight by the wireline (9). At this time the support rod (10) and (11) and move the folding legs (3) with extra force. With the assistance of the restraint by the weight of the surface of the substructure (2) and the lifting wireline, lower the surface of the substructure (2) slowly to its ground base position again.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scissors type vertical elevated substructure comprising:

a base;

a surface connected to the base by a plurality of legs, each of the plurality of legs having a node and one end connected to one of the base and the surface;

a connecting rod connecting two nodes of the plurality of legs such that the plurality of legs are articulated, the plurality of legs and connecting rod form double parallelograms that are mirror images of each other;

a guide device on the base;

a pair of lifting sheaves on the surface;

a sheave on a top of the guide device;

a lifting wireline having a first end connected to one of the nodes of the plurality of legs and a second end that first runs around one of the pair of lifting sheaves, second runs around the sheave on the top of the guide device, and third runs around the sheave on the top of the guide device and connects to a draw works which is adapted to pull the lifting wireline;

a guide pulley on the second surface;

a vertical guide rail on the guide device, the guide pulley sitting in the guide rail;

a first support rod having one end fixed to the plurality of legs and the other end fixed to the base; and a second support rod having one end fixed to the plurality of legs and the other end fixed to the surface.

2. The scissor type vertical elevated support substrate according to claim 1, wherein the folding legs are a variable number whose ends are all articulated with the base and the surface and whose nodes are articulated with a plurality of connection rods.

3. The scissor type vertical elevated support substrate according to claim 2, wherein the number of the folding legs depends upon the amount of equipment on a drill floor and a size of the drill floor.

4. The scissor type vertical elevated support substrate according to claim 1, wherein one of the pair of lifting sheaves one the surface and the sheave on the top of the guide device belong to a pulley assembly including the guide pulley and the guide rail.

5. The scissor type vertical elevated support substrate according to claim 1, wherein the guide device is set on one side of the base and its upper part can be folded downward.

* * * * *